United States Patent [19]

Luitz et al.

[11] Patent Number: 4,519,625

[45] Date of Patent: May 28, 1985

[54] SKI BINDING

[75] Inventors: Max Luitz, Blaichach-Bihlerdorf; Eugen Weiss, Burgberg, both of Fed. Rep. of Germany

[73] Assignee: Ess GmbH Skibindungen, Immenstadt, Fed. Rep. of Germany

[21] Appl. No.: 485,158

[22] Filed: Apr. 15, 1983

[30] Foreign Application Priority Data

Apr. 20, 1982 [DE] Fed. Rep. of Germany ..... 3214585

[51] Int. Cl.[3] ..... A63C 9/00; A63C 9/22

[52] U.S. Cl. ..... 280/633; 280/607; 280/617

[58] Field of Search ..... 280/633, 634, 636, 607, 280/618, 617

[56] References Cited

U.S. PATENT DOCUMENTS

| | | | |
|---|---|---|---|
| 3,198,537 | 8/1965 | Silberman | 280/617 |
| 3,790,186 | 2/1974 | Kanno | 280/617 |
| 4,290,213 | 9/1981 | Solomon | 280/617 |
| 4,441,733 | 4/1984 | Spitaler | 280/633 |

FOREIGN PATENT DOCUMENTS

| | | | |
|---|---|---|---|
| 2617395 | 11/1977 | Fed. Rep. of Germany | 280/633 |

*Primary Examiner*—David M. Mitchell
*Assistant Examiner*—Mark C. Dukes
*Attorney, Agent, or Firm*—Ratner & Prestia

[57] ABSTRACT

The ski binding comprises a toe unit (5) and a heel unit (7) which is connected thereto as a unitary assembly. The assembly is guided slidably lengthwise of the ski in a mounting (3) attached to the ski. By means of a latching arrangement, the assembly is latchable in several slide positions. The mounting has at least one insertion aperture for the point of a ski pole (17). One of the units (7) carries spaced above the insertion aperture two bearing surfaces (11) for the ski pole (17) facing each other lengthwise of the ski, which permit a tilting movement of the ski pole (17) whose point has been inserted into the insertion aperture about an axis transverse to the lengthwise direction of the ski. The ski pole (17) serves as a lever which acts to displace the binding lengthwise of the ski without having to separate the ski (1) from the boot. The latching arrangement can be unlocked by a manual actuating device or by the ski pole (17).

7 Claims, 6 Drawing Figures

SKI BINDING

Figure 1:
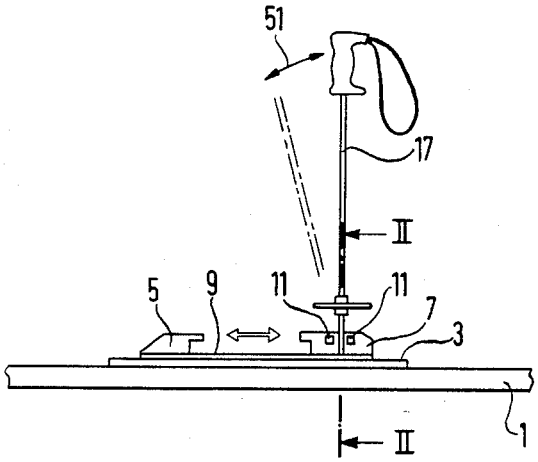

The invention relates to a ski binding, having a toe unit and a heel unit, at least one of which is slidably guided in the lengthwise direction of the ski by means of a mounting firmly attached to the ski and is latchable in several slide positions by means of a latching arrangement.

In known ski bindings, the heel unit is capable of being displaced lengthwise of the ski in order to be able to conform the spacing between units to different boot sizes. During this conforming, however, the position of the heel pressure point changes and with it the slide characteristics of the ski.

It is an object of the invention to provide a ski binding whose position relative to the ski can be adjusted conveniently and without major exertion. In particular, the position of the ski binding relative to the ski is to be displaced without requiring the skier to remove the boot from the binding.

This object is achieved in accordance with the invention by connecting the toe unit and the heel unit into a unitary assembly which is collectively slidable lengthwise of the ski upon the mounting firmly attached to the ski, the mounting having at least one upwardly accessible insertion aperture for the point of a ski pole and one of the units having above the insertion aperture two bearing surfaces for the ski pole facing each other lengthwise of the ski and which permit a tilting movement of the ski pole whose point has been inserted into the insertion aperture about an axis transverse to the lengthwise direction of the ski. The ski pole serves as a lever, by means of which the ski binding can be displaced lengthwise of the ski without major exertion even when it is supporting the weight of the skier. The binding can therefore be adjusted in position without having to remove the ski from the boot.

The latching arrangement has a latching bracket portion movably attached to one of the units which is in resilient closed engagement with an opposing bracket on the mounting periodically recurrent in the lengthwise direction of the ski. By means of an actuating member accessible from outside the unit the latching bracket portion can be disengaged from the opposing latching bracket. The actuating member can be an operating lever which has to be manually operated before the binding assembly is displaced by means of the ski pole. However, in a preferred embodiment it is provided that the actuating member has a slide surface in the insertion and/or tilting path of the ski pole which is displaceable by means of the ski pole transverse to the lengthwise direction of the ski. Through insertion of the ski pole the latching arrangement is unlatched. The binding assembly can then be displaced through tilting or pivoting of the inserted ski pole. Upon pulling the ski pole out, the latching arrangement automatically becomes relatched. The actuating member can be a bent lever, preferably when the latching bracket portion is a latching pin displaceable perpendicularly to the top ski surface.

In other embodiments the actuating member bearing the slide surface can be positioned generally parallel to the top ski surface but displaceable within the units transverse to the lengthwise direction of the ski. Such actuating members provide particularly simple unit constructions, when the latching bracket portion is also displaceable in the same direction and is preferably integrally connected with the actuating member.

In another embodiment, the slide surface of the actuating member can be positioned beneath the insertion aperture of the mounting. Contrary to the previously described embodiments, in which the slide surface cooperates with the shaft of the ski pole, the slide surface of this embodiment is pressed downwardly during unlocking of the latching arrangement by the point of the ski pole.

The bearing surfaces can either be open to the side or be closed in annular configuration. Bearing apertures open to the side are particularly desirable if the slide surface cooperates with the shaft of the ski pole. After insertion of the ski point into the insertion aperture of the mounting, the ski pole can be inserted between the bearing surfaces through a tilting motion about an axis parallel to the lengthwise direction of the ski and the latching arrangement can simultaneously be unlocked.

Figure 2:
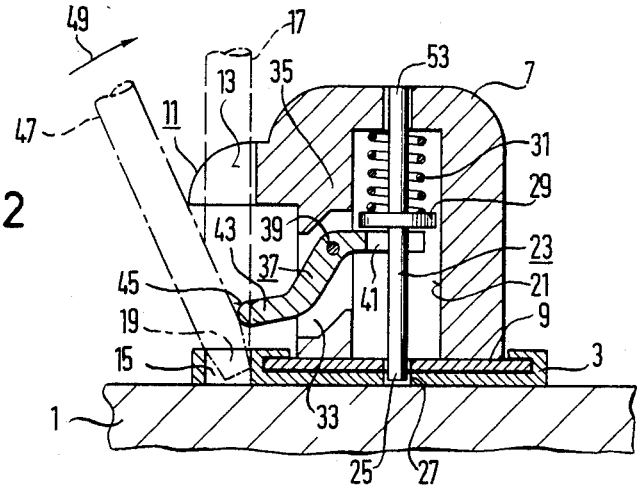
Figure 3:
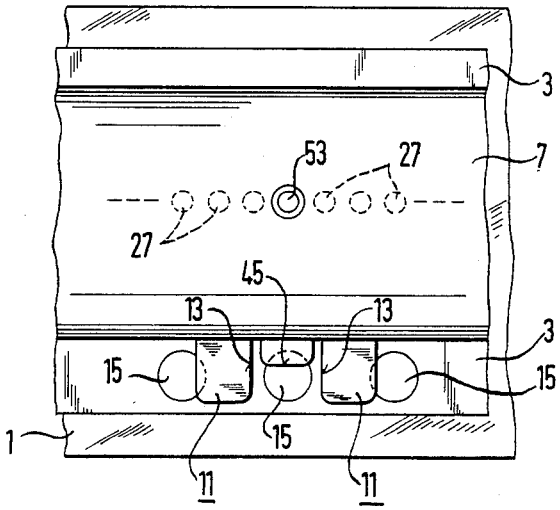
Figure 4:
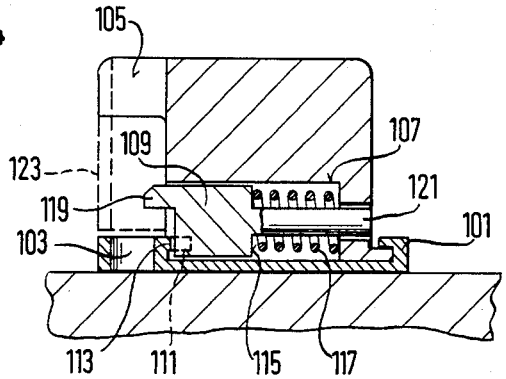
Figure 5:
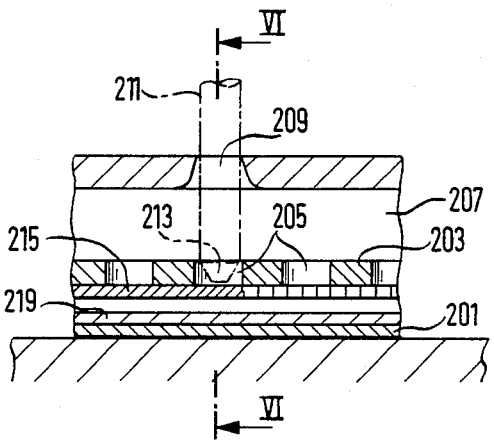
Figure 6:
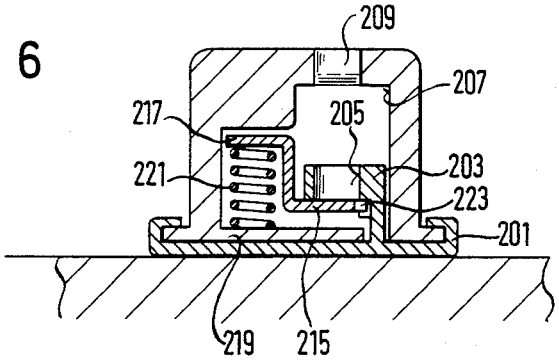

Illustrative embodiments of the invention are further described in what follows in light of the accompanying drawings. There is shown in:

FIG. 1 a diagrammatic partial view of a ski with a binding assembly displaceable lengthwise of the ski;

FIG. 2 a diagrammatic cross-section through the ski according to FIG. 1 along a line II—II;

FIG. 3 a partial top view of the ski according to FIG. 1;

FIG. 4 another embodiment of a latching arrangement usable with the binding of the ski according to FIG. 1;

FIG. 5 a diagrammatic, partial lengthwise cross-section of a further embodiment of a latching arrangement, and FIG. 6 a cross-section through the latching arrangement according to FIG. 5 along a line VI—VI.

FIG. 1 shows a ski 1 to whose top surface there is attached a mounting 3 provided with guides within which a toe unit 5 and a heel unit 7 is guided slidably lengthwise of the ski. The toe unit 5 and the heel unit 7, which may consist of conventional safety units, are connected with each other by a plate 9 into an assembly which is slidable lengthwise of the mounting 3. If desired, one of the units 5, 7 can itself be slidably attached to the plate 9 to make it possible to adjust the assembly for different boot sizes.

One of the units 5 or 7, in this case the heel unit 7, carries at one side surface two bearings 11, vertically spaced from the mounting 3 when in use, with bearing surfaces 13 (FIG. 2) which face each other in the lengthwise ski direction and are spaced from each other. Below the bearings 11, which define between themselves a recess which is open to the side, there are provided one behind the other in the mounting 3 several insertion apertures 15 spaced lengthwise in the direction of the ski. Between the bearings 11, a ski pole 17 can be inserted with its point 19 into one of the insertion apertures 15. The ski pole 17 serves as a lever which, when tilted about its point 19 in a plane lengthwise of the ski, displaces the binding unit forcibly lengthwise of the ski.

The binding assembly is latched in enclosing manner in one of several slide positions by means of a latching arrangement in one of the units, here the heel unit 7. In a housing chamber 21, a latching pin 23 is guided slidably transverse to the ski's upper surface and therefore also to the mounting 3. The end 25 of the latching pin which is close to the mounting can engage one of several latching apertures 27 positioned one behind the other spaced apart lengthwise of the ski. Attached to the latching pin 23 is a disk 29, upon whose side facing away from mounting 3 there is inserted under tension a pressure spring 31 between the housing chamber 21 and the disk 29. The pressure spring 31 holds the latching end 25 in engagement with the latching aperture 27 of mounting 3.

In a gap 33 in one of the housing side walls 35 supporting the bearings 11, a bent lever 37 is borne which is pivotable about a shaft 39 parallel to the lengthwise direction of the ski. The bent lever 37 has a lever arm 41 which is fork-shaped and extends into the housing chamber 21, where it encircles the latching pin and bears against the side of disk 29 remote from the spring. The other lever arm 43, which angles away from the lever arm 41 toward the mounting 3, extends into a region above the insertion aperture 15. Its free end takes the form of a bearing surface 45. The ski pole 17 can, as is indicated in FIG. 2 by a dot-dash line 47, be inserted with its point 19 into the insertion aperture 15 diagonally to the lengthwise upper surface of the ski. By erecting the ski pole 17 in the direction of an arrow 49, the bearing surface 45 is displaced transverse to the lengthwise ski direction and the latching pin 23 is disengaged by means of bent lever 37. Through the pivot movement, the ski pole 17 is simultaneously brought between the bearings 11, so that the unlatched ski binding assembly can now be displaced in the lengthwise ski direction by a pivot movement in the direction of an arrow 51 (FIG. 1). When the ski pole is removed, the pressure spring 31 automatically locks the binding unit to the mounting 3. In order to be able to determine whether the latching pin 23 is engaged in the latching aperture 27, its end facing away from the mounting 3 defines an indicator 53 which extends from the upper surface of the heel unit 7 when the latching pin 23 is lifted out of latching aperture 27. When the latching pin 23 is engaged, then the end surface of the indicator is level with the housing's upper surface, or is recessed below it.

In the foregoing illustrative example, the bearings and the latching arrangement is provided at the heel unit. The bearings and the latching arrangement can also be positioned at the toe unit. In place of the latching arrangement actuatable by the ski pole, there can also be provided a separate manually lockable or unlockable latching arrangement, e.g. by means of a manual operating lever supported pivotably upon the unit. Such a latching arrangement can also be provided upon one of the units, whereas the bearings for the slidable displacement of the binding assembly by means of the ski pole can be located at the other unit.

FIG. 4 shows another embodiment of a ski binding unit which, together with its opposite unit, is displaceable as an assembly lengthwise of a mounting 101 firmly attached to the ski. The mounting 101 bears insertion apertures 103 open toward the top for the point of a ski pole. Spaced above the insertion aperture 103 there are provided upon the unit bearings having two bearing surfaces 105 facing each other in the lengthwise ski direction. The bearings are open to the side and correspond to the bearings 11 of FIGS. 1 to 3. A ski pole which is inserted with its point into the insertion aperture 103 between the bearing surfaces 105 serves as a lever, by means of which the unit can be forcibly displaced in the lengthwise direction of the ski. For further explanation, reference is made to the description of FIGS. 1 to 3. In a housing chamber 107 of the unit, there is guided a latching pin 109 slidable generally parallel to the ski's upper surface but transverse to the ski's lengthwise direction. The latching pin 109 has latching projections 111 upon its side facing the insertion apertures 103, which engage latching recesses within an adjoining latching track 113 of the mounting 101. A pressure spring 117, which is inserted between the housing chamber 107 and a shoulder 115 facing away from the latching projections of the latching pin 109, holds the latching projections 111 in engagement with the latching track 113. From the latching pin 109 there extends in the sliding direction of the pin a bearing member 119, whose forward end extends above the insertion aperture 103. The latching pin 109 is unlocked via its bearing member 119 upon insertion of the ski pole, as was explained with reference to FIGS. 1 through 3. Upon removal of the ski pole, the pressure spring 117 automatically engages the latching protrusions into the latching track 113. The end of the latching pin 109 which faces away from the bearing member 111 in the sliding direction again forms an indicator 121, which extends beyond the unit's outer surface when the latching pin 109 is disengaged, and which is level with that surface or recessed below the same when the latching pin 109 is engaged.

In the previously described embodiments, the bearings are open toward the side of the unit. As shown in FIG. 4 at 123, the bearings can also be connected to each other to form a closed channel into which the ski pole is insertable from above. If appropriate, the bearing surfaces of the latching pins can also be provided with sloping lead-in surfaces for the point of the ski pole.

FIGS. 5 and 6 show another unit of a ski binding which is connected into a single assembly with its opposing unit, and which is slidably guided in the lengthwise ski direction upon a mounting 201. The mounting 201 includes a track 203 which extends lengthwise and has several insertion apertures 205 displaced one behind the other lengthwise of the ski. The track 203 is positioned within a housing chamber 207 of the unit, which has an annular bearing aperture 209 spaced above the track 203. Through the bearing aperture 209 a ski pole indicated at 211 can be introduced with its point 213 into the housing chamber 207 and the insertion aperture 205. The ski pole serves as a lever by means of which the assembly can be displaced lengthwise of the ski.

On the side of track 203 which faces away from bearing aperture 209, a plate 215 covers the region of insertion aperture 205. This plate is retained spaced in the lengthwise direction of the ski from the end near the bearing aperture 209 and is so formed that it can be displaced generally perpendicularly to the ski surface without resistance in the region of the bearing aperture 209. The plate 215 may be an elastic sheet or the like. To the side of plate 215, viewed in the lengthwise direction of the ski, a pressure spring 221 is placed under tension between a ledge 217 of plate 215 and a bottom member 219 of the housing chamber 207, which urges the plate 215 away from the ski's upper surface toward track 203. On the side of plate 215 which lies opposite ledge 217 in the transverse direction of the ski there are provided latching projections 223 which engage complementary recesses in track 203 and which make it possible to latch the unit assembly in predetermined positions.

To displace the unit assembly, the ski pole is inserted from above through the bearing aperture 209 and with its point 213 presses the plate 215 downwardly. Thereby, the latching projections 223 are moved out of engagement with the recesses in track 203. By pivoting of the pressed-down ski pole 211, the unit assembly can be slidably displaced. Upon removal of the ski pole, the pressure spring 221 automatically locks the unit assembly to the mounting 201.

We claim:

1. Ski binding having a toe unit and a heel unit of which at least one is guided slidably in the lengthwise ski direction upon a mounting attached to the ski and is latchable in several slide positions by means of a latching arrangement having a movable latching bracket portion which resiliently engages an opposing bracket of the mounting, the latching bracket portion capable of being disengaged from the opposing bracket by means of an actuating member which is accessible from outside the mounting, characterized in that the toe unit and the heel unit are connected together into a common assembly slidable upon the mounting attached to the ski lengthwise in the ski direction; that the mounting has at least one insertion aperture accessible from above for the point of a ski pole; that one of the units has spaced above the insertion aperture two bearng surfaces for the ski pole in the form of leg surfaces facing each other and extending transversely to the lengthwise direction of the ski to form a generally U-shaped recess open laterally of the unit when viewed from the top which permit a tilting movement of a ski pole, inserted with its point into the insertion aperture, about an axis parallel to the lengthwise ski direction; and that the actuating member has a bearing surface in the insertion-and/or tilt path of the ski pole which is capable of being displaced transverse to the lengthwise direction of the ski by means of the ski pole.

2. Ski binding according to claim 1, characterized in that the actuating member has the form of a bent lever which is supported pivotably about a shaft extending generally in the lengthwise ski direction; that a first level arm of the bent lever carries the bearing surface of the actuating member and is positioned between the two bearing surfaces for the ski pole; and that a second lever arm carries the latching bracket portion or is coupled thereto.

3. Ski binding according to claim 2, characterized in that the latching bracket portion takes the form of a latching pin which is slidably displaceable in the unit transverse to the ski's upper surface and which is pretensioned by a spring toward the mounting; that the first lever arm is angled away from the second lever arm toward the mounting; and that the second lever arm extends below a shoulder of the latching pin pointing toward the mounting.

4. Ski binding according to claim 3, characterized in that the latching bracket portion is positioned perpendicularly slidable with respect to the ski's upper surface.

5. Ski binding according to claim 1, characterized in that the actuating member which supports the bearing surface is slidably displaceable generally parallel to the ski's upper surface in a direction which extends transverse to the lengthwise ski direction and is coupled or firmly attached to the latching bracket member.

6. Ski binding according to claim 5, characterized in that the latching bracket portion takes the form of a latching pin which forms a unit with the actuating member, and is pretensioned by a spring toward the bearing surface in latching engagement with the opposing latching bracket of the mounting.

7. Ski binding according to claim 1, characterized in that the latching bracket portion has an indicator portion on the side pointing away from the opposing latching bracket in the insertion direction, which is slidably displaceable in an outwardly opening aperture in such manner that the indicator portion extends outwardly from the aperture when the latching bracket portion is brought out of engagement with the opposing latching portion and is a closure level with the outer edge of the aperture, or withdrawn into the aperture, when the latching bracket portion is engaged with the opposing latching bracket.

* * * * *